US008295721B2

(12) United States Patent
Murayama

(10) Patent No.: US 8,295,721 B2
(45) Date of Patent: Oct. 23, 2012

(54) IMAGE-FORMING DEVICE FOR CORRECTING AN IMAGE FORMATION POSITION

(75) Inventor: Kentaro Murayama, Kasugai (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 958 days.

(21) Appl. No.: 12/056,565

(22) Filed: Mar. 27, 2008

(65) Prior Publication Data

US 2008/0240752 A1 Oct. 2, 2008

(30) Foreign Application Priority Data

Mar. 27, 2007 (JP) ..... 2007-082476

(51) Int. Cl.
*G03G 15/00* (2006.01)

(52) U.S. Cl. ..... 399/49; 399/66; 399/301

(58) Field of Classification Search ..... 399/44, 399/49, 66, 301

See application file for complete search history.

(56) References Cited

U.S. PATENT DOCUMENTS

| | | | | |
|---|---|---|---|---|
| 6,038,423 | A * | 3/2000 | Tagawa et al. | 399/301 |
| 2006/0177247 | A1* | 8/2006 | Tanaka et al. | 399/301 |
| 2007/0297820 | A1* | 12/2007 | Shirakata | 399/44 |
| 2008/0285994 | A1* | 11/2008 | Tamura | 399/66 |

FOREIGN PATENT DOCUMENTS

| | | | |
|---|---|---|---|
| JP | 11-231750 | A | 8/1999 |
| JP | 2000-47546 | A | 2/2000 |
| JP | 2001-228670 | A | 8/2001 |
| JP | 2005-284116 | A | 10/2005 |

* cited by examiner

*Primary Examiner* — David Gray
*Assistant Examiner* — Andrew Do
(74) *Attorney, Agent, or Firm* — Banner & Witcoff, Ltd.

(57) ABSTRACT

An image-forming device includes an image bearing member, a data providing unit, an image-forming unit, a detecting unit, a first calculating unit, a determining unit, and a second calculating unit. The image bearing member has a surface moving at a surface speed. The data providing unit provides pattern data indicative of a target test pattern to be formed on a target position of the surface in response to a test instruction. The image-forming unit forms an actual test pattern on an actual position of the surface in accordance with the pattern data provided from the data providing unit, and configure to form an image in response to an image-forming instruction. The detecting unit detects the actual position. The first calculating unit calculates a deviation of the actual position from the target position. The determining unit performs a first determination of whether the surface speed when the data providing unit receives the test instruction is stable or unstable. The second calculating unit calculates a correction amount based on the deviation and the first determination. The image-forming unit forms, in response to the image-forming instruction, an image on a position of the surface. The position is corrected based on the correction amount.

21 Claims, 11 Drawing Sheets

IMAGE-FORMING DEVICE FOR CORRECTING AN IMAGE FORMATION POSITION

CROSS REFERENCE TO RELATED APPLICATION

This application claims priority from Japanese Patent Application No. 2007-082476 filed Mar. 27, 2007. The entire content of each of these priority applications is incorporated herein by reference.

TECHNICAL FIELD

The present invention relates to an image-forming device.

BACKGROUND

An image-forming device can form an image at an image formation position on a recording medium, which deviates from the right position due to a physical shock from the outside or another cause, for example. For this reason, some conventional image-forming devices have a function for correcting the deviation of the image formation position based on a test pattern. Responsive to a test instruction, such image-forming device forms a test pattern for registration on a belt which drives rotationally to transfer recording medium. Then, the image-forming device detects the position of the pattern formed on the belt with an optical sensor or another device, and corrects the image formation position based on the result of the detection. After that, responsive to an image forming instruction, the image-forming device forms an image at the corrected image formation position.

Japanese unexamined patent application publication No. 2001-228670 describes that variation in the temperature of the inside of the image-forming device affects the image formation position. Especially, the fixing unit is the major cause of the variation in the inner temperature of the image-forming device. Thus, the image-forming device described in Japanese unexamined patent application publication No. 2001-228670 forms a pattern at the time when a predetermined time has elapsed since the fixing unit had been turned on. Then, the image-forming device detects the pattern and corrects the image formation position based on the result of the detection.

In addition, Japanese unexamined patent application publication No. HEI11-231750 discloses an image-forming device that obtains information of the position of a pattern and the temperature of the inside of the apparatus at a predetermined timing, and substitutes the obtained information and temperature into a predetermined function to calculate a position deviation amount that occurs after a predetermined time period has elapsed.

SUMMARY

In recent years, a large demand is arising to reduce time between the time when the power switch is turned on or the image forming instruction is issued to the image-forming device that is in a sleep state and the time when an image forming process is started. However, if the image formation process is started immediately after the turning on the image-forming device, the image formation process is compelled to be carried out in a state where the inner temperature of the apparatus is unstable since the temperature of the fixing unit has not reach the target temperature. If the image formation position is corrected based on a pattern detected in the state in which the inner temperature of the apparatus is stable at the target temperature, the image formation position relative to a recording medium deviates from the right position due to the difference between the inner temperature when the pattern is detected (the test instruction is issued) and the inner temperature when the image formation instruction is issued. To avoid this problem, it is necessary to take into consideration the state in which the image-forming device has detected the pattern.

The image-forming device disclosed in Japanese unexamined patent application publication No. 2001-228670 detects the pattern formed when a predetermined time period has passed since the fixing unit had turned on. However, if the correction result obtained based on the detection is used without being modified under a different temperature condition, the image formation position relative to a recording medium also deviates from the right position. Further, the image-forming device disclosed in Japanese unexamined patent application publication No. HEI11-231750 does not consider the state of the image-forming device when the pattern position information to be substituted into the calculation function has been detected.

In view of the above-described drawbacks, it is an objective of the present invention to provide an image-forming device capable of restraining a correction error of an image formation position which occurs due to the difference in a state of the image-forming device between the time of a test instruction and the time of an image forming instruction.

In order to attain the above and other objects, the present invention provides an image-forming device including an image bearing member, a data providing unit, an image-forming unit, a detecting unit, a first calculating unit, a determining unit, and a second calculating unit. The image bearing member has a surface moving at a surface speed. The data providing unit provides pattern data indicative of a target test pattern to be formed on a target position of the surface in response to a test instruction. The image-forming unit forms an actual test pattern on an actual position of the surface in accordance with the pattern data provided from the data providing unit, and configure to form an image in response to an image-forming instruction. The detecting unit detects the actual position. The first calculating unit calculates a deviation of the actual position from the target position. The determining unit performs a first determination of whether the surface speed when the data providing unit receives the test instruction is stable or unstable. The second calculating unit calculates a correction amount based on the deviation and the first determination. The image-forming unit forms, in response to the image-forming instruction, an image on a position of the surface. The position is corrected based on the correction amount.

BRIEF DESCRIPTION OF THE DRAWINGS

The particular features and advantages of the invention as well as other objects will become apparent from the following description taken in connection with the accompanying drawings, in which:

FIG. 7 is a graph showing an experiment result of variation in mark positions of measurement colors from the time when the power switch is turned on or the like;

DETAILED DESCRIPTION

First Embodiment

A first embodiment of the present invention will be described with reference to FIGS. 1-9.

(The Entire Configuration of a Printer)

Figure 1:
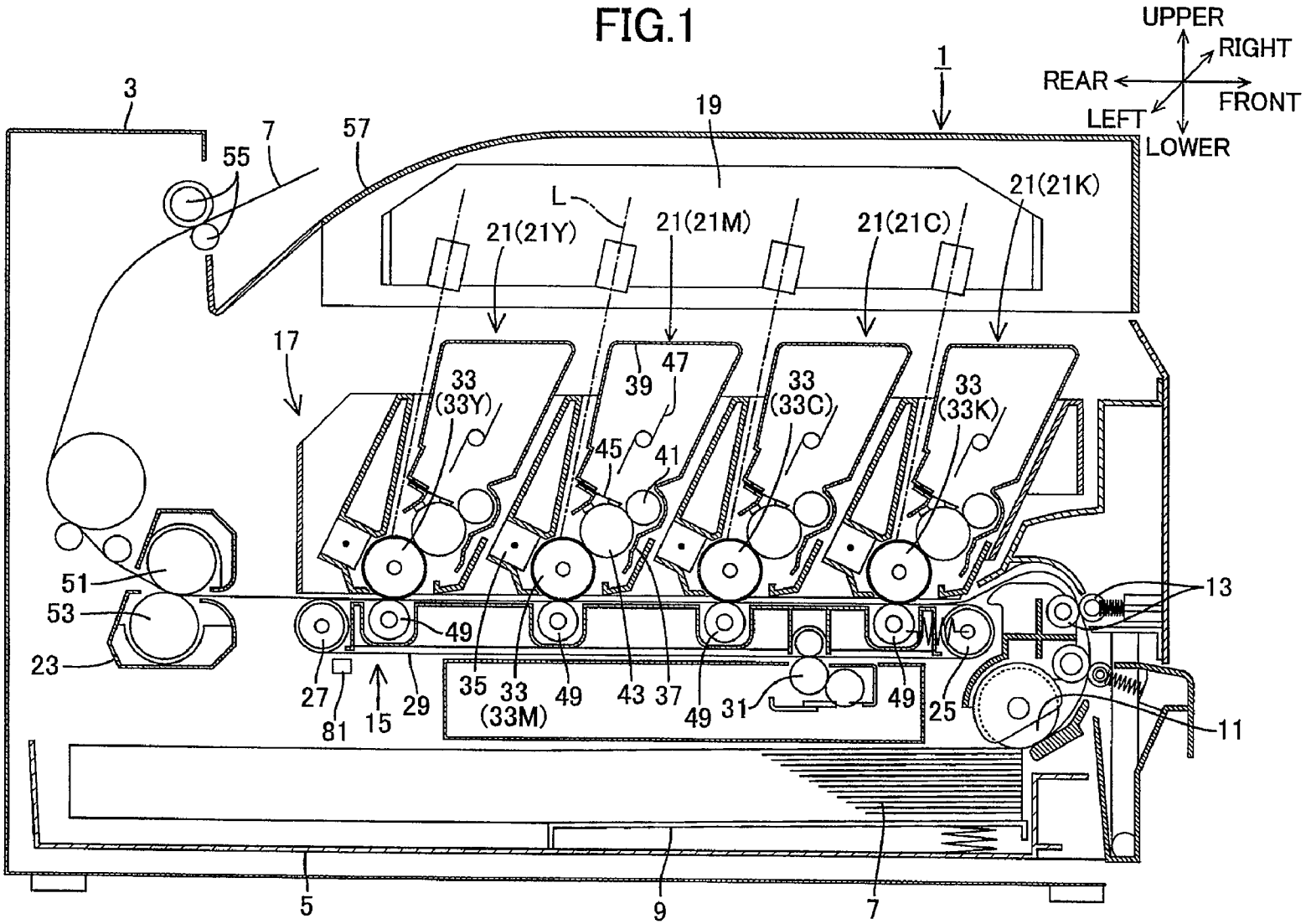
FIG. 1 is a sectional side view illustrating the schematic configuration of a printer according to a first embodiment of the present invention.

FIG. 1 is a sectional side view illustrating a schematic configuration of a printer 1 according to the first embodiment. In the following description, the right side (rightward) of FIG. 1 is assumed to be the front side (forward) of the printer 1.

As shown in FIG. 1, the printer 1 is a tandem-electrophotographic direct-transferring color laser printer and is provided with a casing 3. A tray feeder 5 in which recording medium (exemplified by paper sheets) 7 are stocked is disposed at the bottom of the casing 3.

The recording medium 7 is pressed against a pickup roller 11 by a pressing board 9, and is sent to a resist roller 13 by rotation of the pickup roller 11. The resist roller 13 corrects a skew of the recording medium 7 and then sends the recording medium 7 to a belt unit 15 at a predetermined timing.

An image forming unit 17 includes the belt unit 15, a scanner unit 19, process units 21, a fixing unit 23 and other elements.

The belt unit 15 includes an endless belt 29 provided between a pair of supporting rollers 25 and 27. The belt 29 is circularly rotated in the counter-clockwise direction in FIG. 1 by, for example, rotation of the rear supporting roller 27, so that a recording medium on the belt 29 is transferred to the rearward.

Further, a cleaning roller 31 is provided below the belt unit 15 in order to remove toner, such as a registration pattern 91 described below, paper dusts, and others adhered to the belt 29.

The scanner unit 19 includes a laser light emitting section (not shown) which is on/off-controlled based on image data, and irradiates a photosensitive drum of each color with laser beam L corresponding to an image of the color and concurrently makes high-speed scan.

Four process units 21 corresponding to the four colors of black, cyan, magenta, and yellow respectively are same in configuration except the colors of toner. Hereinafter, reference numbers 21 with corresponding subscripts of K (black), C (cyan), M (magenta) and Y (yellow) are used when it is necessary to discriminate the process units 21 in colors from one another, but the subscripts are to be omitted when no discrimination is needed.

Each process unit 21 includes a photosensitive drum 33, a charger 35, a developer cartridge 37, and other elements.

The developer cartridge 37 has a toner container 39, a supplying roller 41, a developing roller 43, and a layer thickness limiting blade 45.

Toner is supplied to the developing roller 43 by rotation of an agitator 47 and rotation of the supplying roller 41. The toner supplied to the surface of developing roller 43 enters a space between the layer thickness limiting blade 45 and the developing roller 43 to thereby be formed into a thin layer having a uniform thickness carried on the developing roller 43.

The surface of each photosensitive drum 33 is uniformly and positively charged by the charger 35, and then exposed by laser beam L from the scanner unit 19. Consequently, on the surface of the photosensitive drums 33, electrostatic latent images corresponding one to each of the colors are formed.

The toners born on the developing rollers 43 are supplied to electrostatic latent images formed on the surfaces of photosensitive drums 33, so that the electrostatic latent images become visible in the form of toner images, one in each of the corresponding colors.

While a recording medium 7 passes through each transferring position between the photosensitive drum 33 and a transferring roller 49 by the belt 29, a negative transferring bias is applied to the transferring roller 49. Thus, toner images born on the surface of the photosensitive drums 33 are transferred onto the recording medium 7. The recording medium 7 is then transferred to the fixing unit 23.

A heating roller 51 and a pressure roller 53 of the fixing unit 23 heats the recording medium 7 holding the toner image thereon while transferring the recording medium 7, so that the toner image is thermally fixed to the surface of the recording medium 7. Then, the recording medium 7 is discharged onto a discharging tray 57 by a discharging roller 55.

As shown in FIG. 1, the printer 1 further includes an optical sensor 81 arranged under the rearward of the belt 29. The optical sensor 81 is a reflective sensor including a phototransmitter and a photoreceptor. The phototransmitter diagonally irradiates the surface of the belt 29 with light. The photoreceptor receives light reflected by the surface of the belt 29 and outputs a binary signal indicating whether or not there is a mark 93 of a registration pattern 91 (described later) in the detection region.

(Electric Configuration of the Printer)

Figure 2:
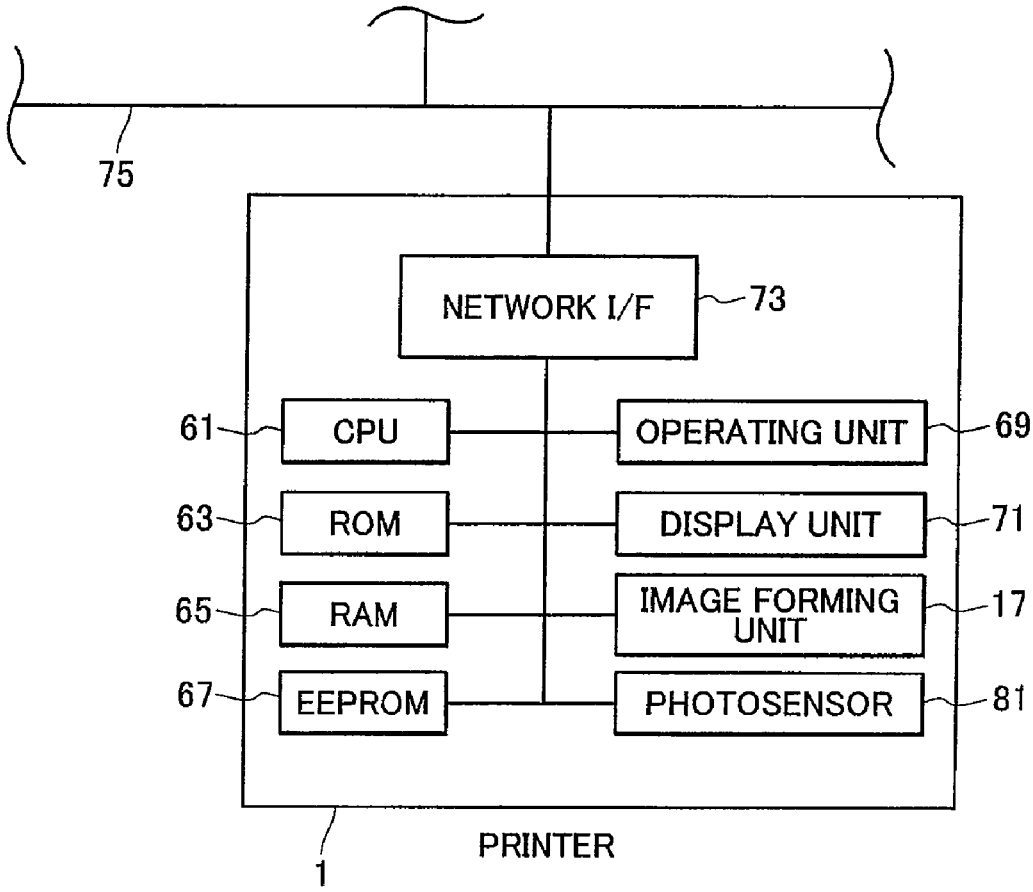
FIG. 2 is a block diagram schematically showing the electrical configuration of the printer of FIG. 1.

FIG. 2 is a block diagram schematically showing the electrical configuration of the printer 1.

The printer 1 includes a CPU 61, a ROM 63, a RAM 65, an EEPROM (a non-volatile memory) 67, an operating unit 69, a display unit 71, the above-described image forming unit 17, a network interface 73, the optical sensor 81, and others.

The ROM 63 stores various programs for controlling operations of the printer 1. The CPU 61 controls operations of the printer 1 in accordance with programs read from the ROM 63, while storing the process results into the RAM 65 and/or the EEPROM 67.

The operating unit 69 has a plurality of buttons with which a user can perform various input operations, such as an instruction to start printing. The display unit 71 is formed by an LCD and lamps and can display various setting screen and an operation state thereon. The network interface 73 is connected to an external computer (not shown) through a communication line 75 and consequently makes mutual data communication possible.

(Process to Correct Position Deviation)

If image formation positions (transferring positions) on a recording medium are deviated from one another for each color, color images with color registration error is formed. In order to avoid such color registration error, a position deviation correcting process is performed. In the position deviation correcting process, black is regarded as the reference color and the remaining colors (yellow, magenta, and cyan) are regarded as measurement colors, and a deviation of the image formation position of each measurement color from the image formation position of the reference color is corrected. FIGS. 3-6 are schematically show patterns formed on the belt 29 at various operation stages. Each of the drawing shows the top view, the side view and the bottom view of the belt 29 from the top of the drawing.

1. Registration Pattern

Figure 4:
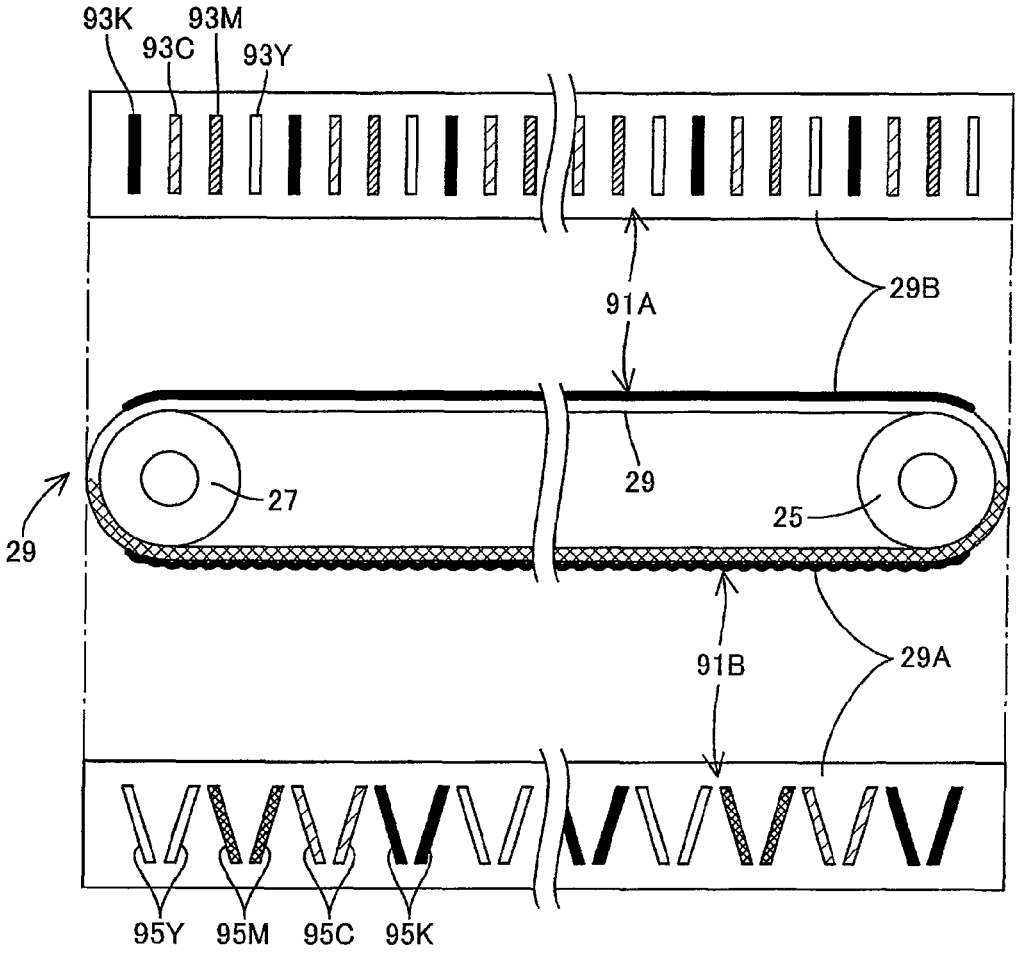
FIG. 4 is a diagram schematically showing patterns formed on the belt while the belt makes a revolution in the first operation.
Figure 5:
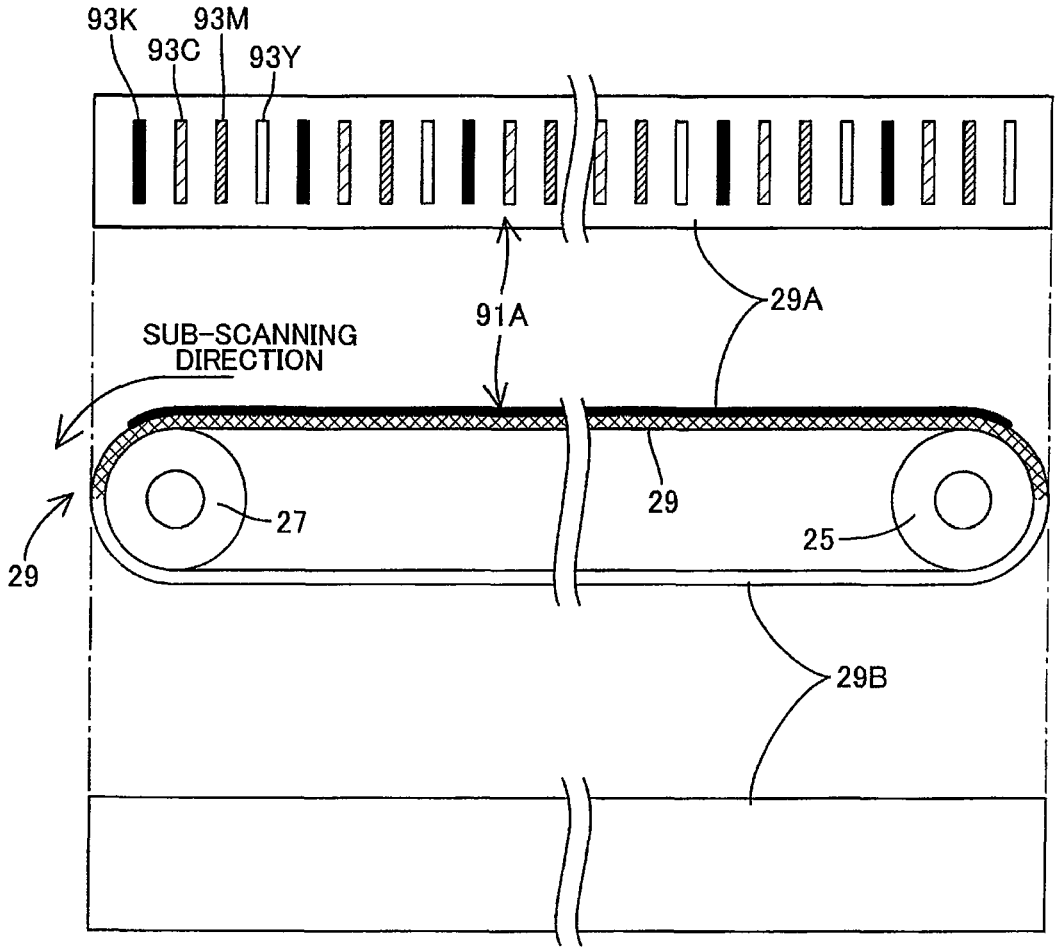
FIG. 5 is a diagram schematically showing patterns formed on the belt while the belt makes half revolution in a second operation.
Figure 6:
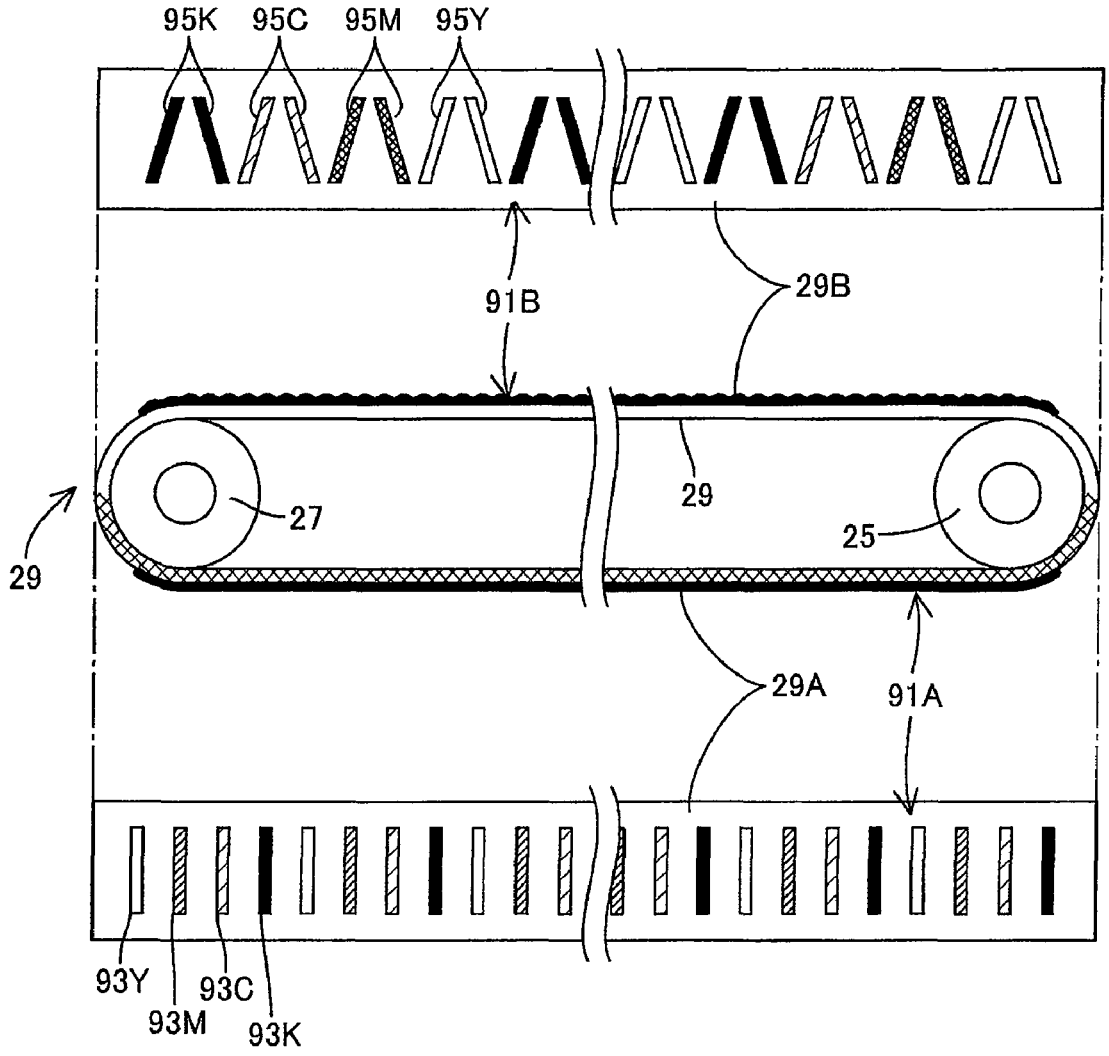
FIG. 6 is a diagram schematically showing patterns formed on the belt while the belt makes a revolution in the second operation.

FIGS. 4-6 show first registration patterns (hereinafter, simply called first patterns 91A). The first patterns 91A are used to detect deviations of image formation positions on the belt 29 in the rotation direction (the machine direction of the printer 1, hereinafter called a "sub-scanning direction"). Specifically, the first patterns 91A are formed by a plurality of bar-shaped marks 93 which extend in the side-to-side direction, and are arranged in the movement direction of the belt 29. In addition, the first pattern 91A includes one or more mark sets each having a black mark 93K, a yellow mark 93Y, a magenta mark 93M, and a cyan mark 93C arranged in this order in the sub-scanning direction.

Figure 3:
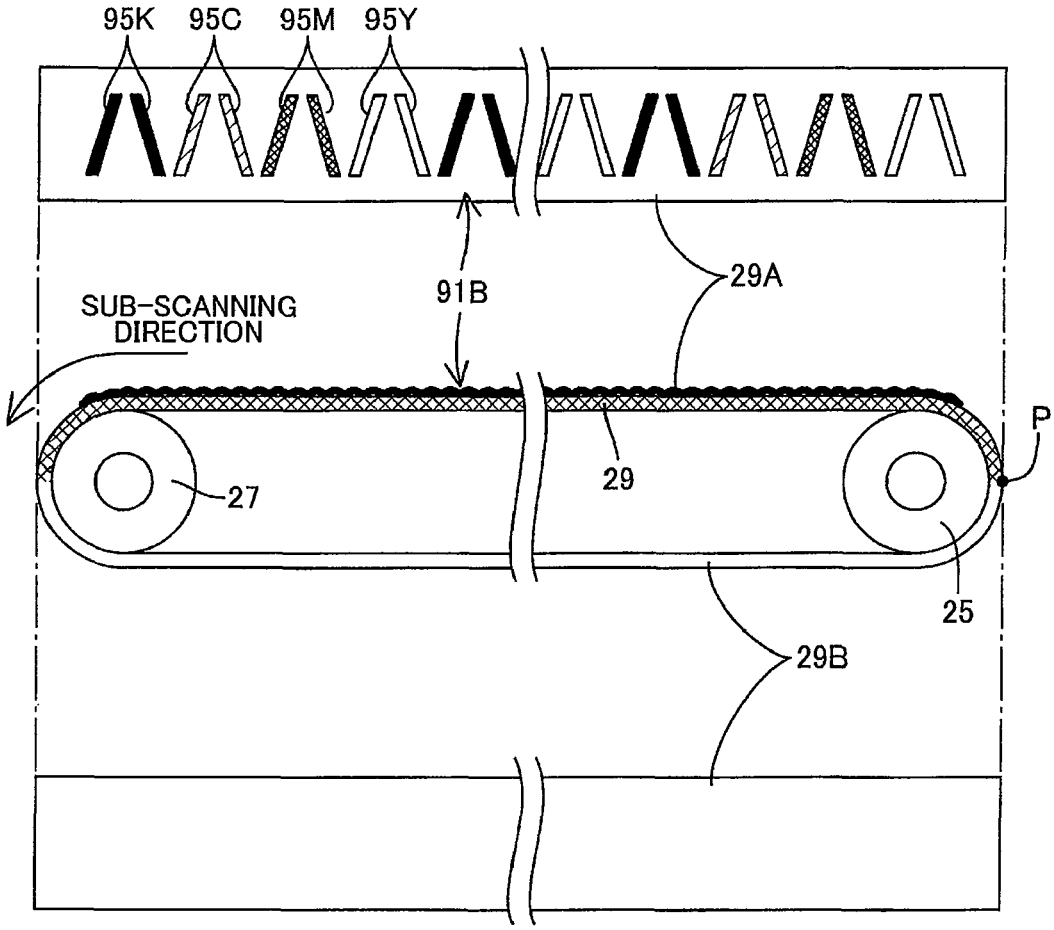
FIG. 3 is a diagram schematically showing patterns formed on a belt while the belt makes half revolution in a first operation.

FIGS. 3, 4, and 6 show second registration patterns (hereinafter, simply called second patterns 91B). The second patterns are used to detect deviations of image formation positions on the belt 29 in the direction (the side-to-side direction of the printer 1, hereinafter called the "main-scanning direction") perpendicular to the above sub-scanning direction. Specifically, the second patterns 91B are formed by a plurality of pairs of bar-shaped marks 95 forming respective different angles with respect to the main-scanning direction, and are arranged in the movement direction of the belt 29. The plurality of pairs of marks 95 includes a plurality of pairs of black marks 95K, a plurality of pairs of yellow marks 95Y, a plurality of pairs of magenta marks 95M, and a plurality of pairs of cyan marks 95C. Data of the first pattern 91A and data of the second pattern 91B are recorded in, for example, the EEPROM 67.

2. Relationship Between the Belt Speed and a Variation in the Image Formation Position When a power switch is turned on, the printer 1 starts control of rotational driving of the belt 29 and raising the temperature of the fixing unit 23 to a target temperature (at which an image can be thermally fixed, e.g., 200° C.). In the present embodiment, if an image forming instruction is not issued by a user for a predetermined time period after the power switch has been turned on, the printer 1 comes to be in a sleep state. In the sleep state, the temperature of the fixing unit 23 becomes lower than the target temperature and the belt 29 halts the rotational driving. Then, when the printer 1 returns from the sleep state, the control of rotational driving of the belt 29 and raising the temperature of the fixing unit 23 to the target temperature are started again.

Figure 7:
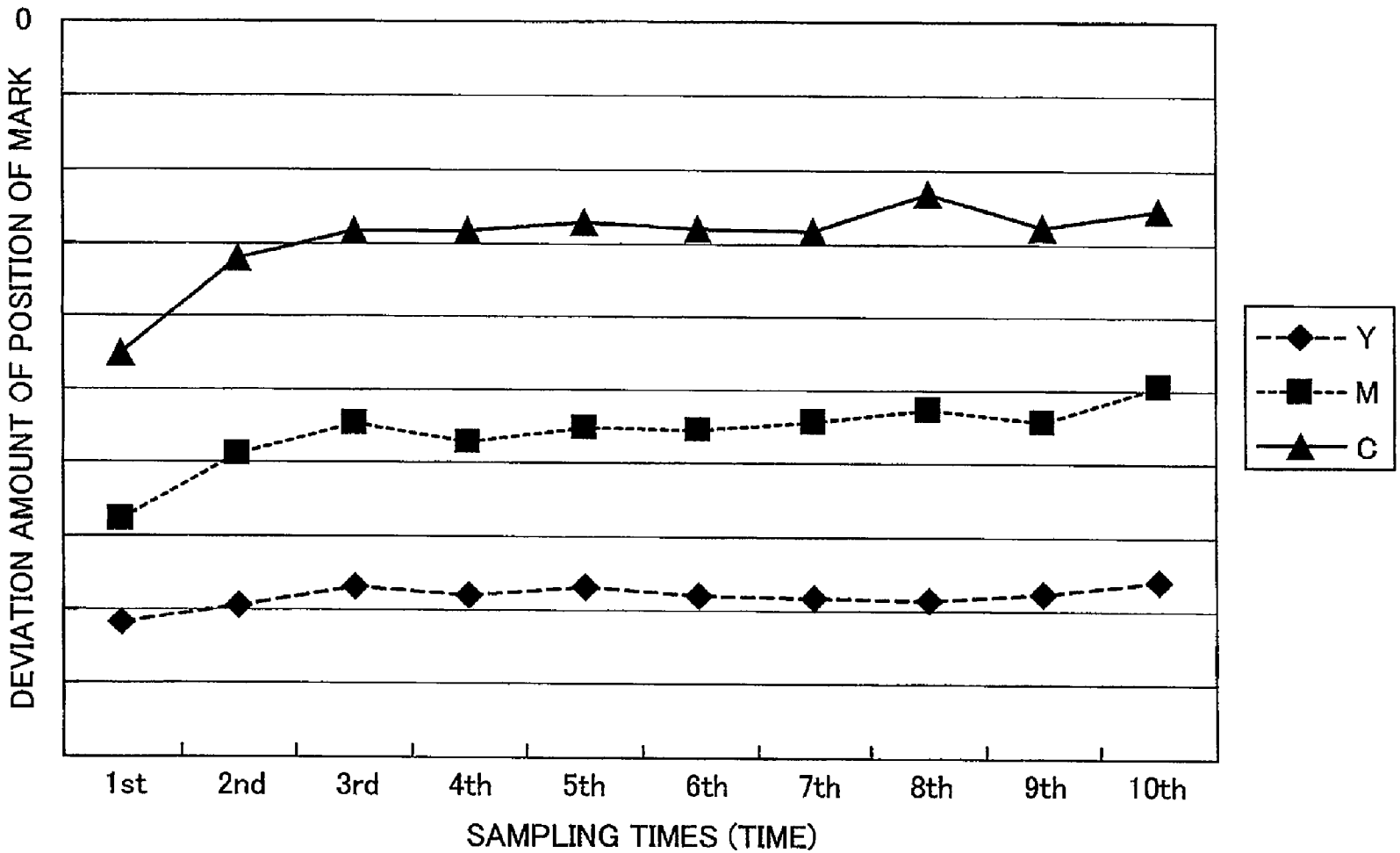

FIG. 7 is a graph showing an experimental result obtained by sequentially sampling the positions of the marks 93 of each measurement color after the power switch is turned to on or the printer 1 returns from the sleep state (hereinafter referred to as "the time when the power switch is turned on or the like"). In FIG. 7, zero position of the position deviation amount is the position of the mark 93K of the reference color on the belt 29. The distance between the zero position and each plot represents the position deviation amount of the measurement color with respect to the reference-color mark 93K.

As shown in FIG. 7, immediately after the power switch is turned on or the like, the temperature of the fixing unit 23 is unstable since the temperature has not reach the target temperature yet. Thus, the thickness of the belt 29 is not constant. Further, the rotation speed of the belt 29 (i.e., the rotation speed of supporting rollers 25 and 27) is also unstable since the speed has not reach the set speed yet. Accordingly, the surface speed of the belt 29 can be estimated to be unstable (hereinafter, this state is referred to as an "unstable state"). Therefore, the position of the mark 93 of each measurement color varies with time passage.

After that, when the temperature of the fixing unit 23 reaches the target temperature and becomes stable at the target temperature, and the rotation speed of the belt 29 reaches the set speed and becomes stable at the set speed, the surface speed of the belt 29 is assumed to become substantially stable at a substantially constant speed and the position of the mark 93 of each measurement color is assumed to become stable at a substantially constant position (hereinafter, this state is referred to as a "stable state"). On the other hand, if the position of the marks 93 is detected in the unstable state and the image formation positions of measurement colors are corrected in the stable state based on only the marks 93 detected the unstable state, images with the registration error may be formed, since the surface speed of the belt 29 when the positions of the marks 93 are detected is different from the surface speed of the belt 29 when the image is formed.

Note that even if the control of either rotational driving of the belt 29 or the temperature of the fixing unit 23 to the target temperature is started at the time when the power switch is turned on or the like, the variations are estimated to show the substantially same tendency as those shown in FIG. 7 while the position deviation amounts themselves are less than those of FIG. 7.

3. Detection of Pattern Position

When a test instruction is issued, the image forming unit 17 carries out the following first and second operations during the position deviation correcting process.

In the first operation, as shown in FIG. 3, the second pattern 91B is formed on a first region 29A of about the half of the belt 29 while a predetermined reference point P on the belt 29 reaches, for example, the side of the supporting roller 27 from the side of the supporting roller 25, in other words, while the belt 29 makes half revolution from the start of the first operation. Next, the first pattern 91A is formed on the second region 29B of the remaining half of the belt 29 while the predetermined reference point P reaches the side of the supporting roller 25 from the side of the supporting roller 27, in other words, while the belt 29 further makes half revolution after the completion of the formation of the second pattern 91B, as shown in FIG. 4.

After completion of the first operation, the cleaning roller 31 cleans off the first pattern 91A. After 30 seconds has elapsed since the first operation had been completed, the second operation is performed. The image forming unit 17 starts performing the second operation at the timing when the reference point P on the belt 29 reaches a position that is same as a position at which the first operation is started (the same position as that shown in FIG. 3). This timing can be determined in advance based on the starting timing of the above first operation and the set speed of the belt 29.

In the second operation, the first pattern 91A is formed on the first region 29A of the belt 29, as shown in FIG. 5, while the reference point P makes half revolution from the start of the first operation, and successively the second pattern 91B is formed on the second region 29B as shown in FIG. 6, while the belt 29 further makes half revolution from the completion of formation of the first pattern 91A.

In short, the second operation forms the second pattern 91B on a region on which the first operation has formed the first pattern 91A and forms the first pattern 91A on a region on which the first operation has formed the second pattern 91B. After the completion of the second operation, the cleaning roller 31 also cleans the belt 29.

Figure 8:
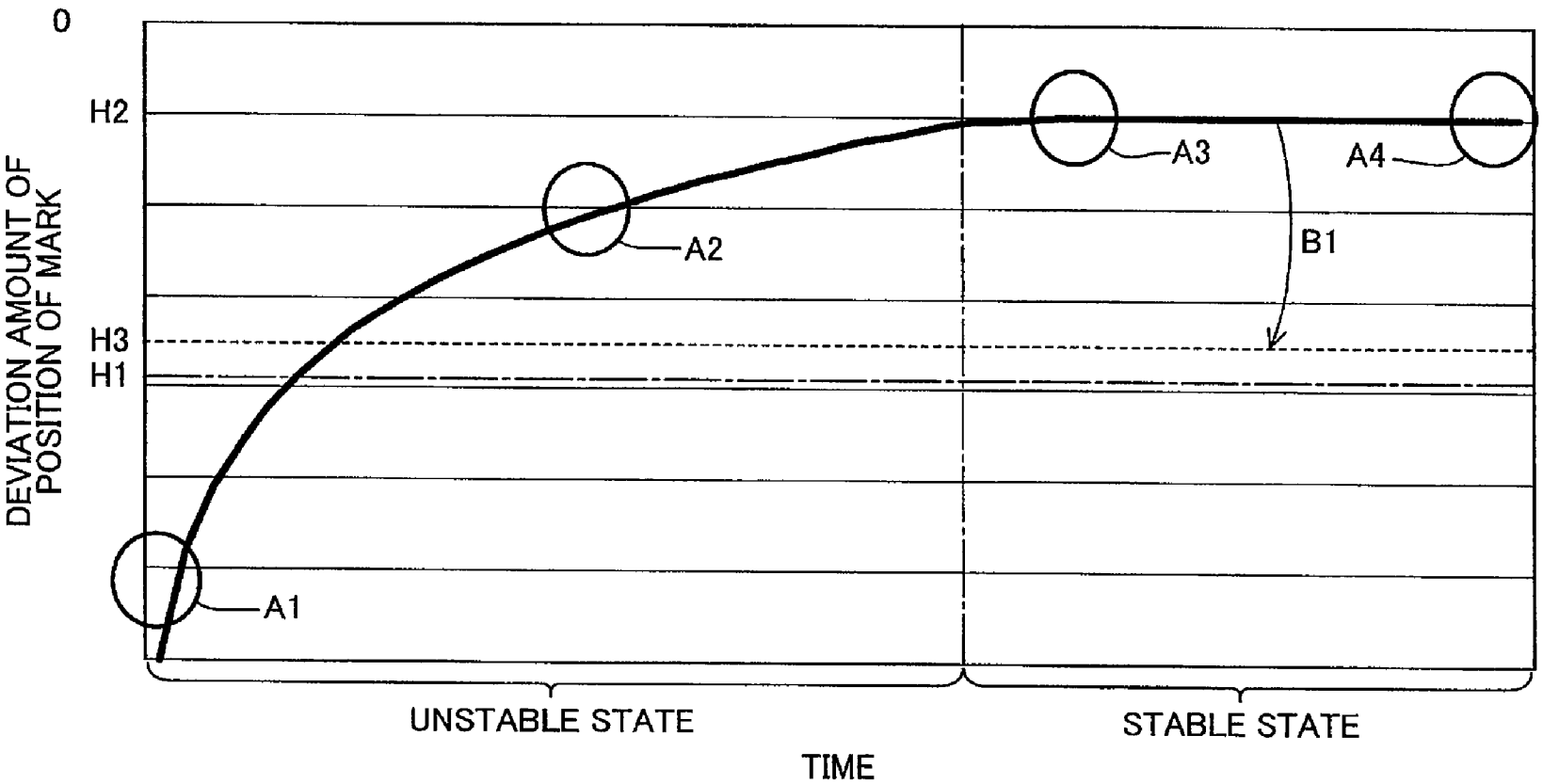
FIG. 8 is a graph showing the relationship of the variation in a mark position with execution timings of the first operation and the second operation.

Further, the image forming unit 17 obtains binary signals sequentially sent from the optical sensor 81 during the first operation and the second operation. FIG. 8 is a graph showing the variation in the position of the mark 93 having one measurement color. In FIG. 8, immediately after the power switch is turned on or the like, the test instruction is issued, that is, first operation is carried out and after a predetermined time period (e.g., 30 seconds) has elapsed since the first operation had been completed, the second operation is carried out. Further, in this embodiment, relative to the position of the mark 93 formed during the first operation, the position of the mark 93 formed during the second operation comes close to approximately 70-80 percent of the mark 93 formed in the stable state.

4. Contents of Control of the Position Deviation Correcting Process

Figure 9:
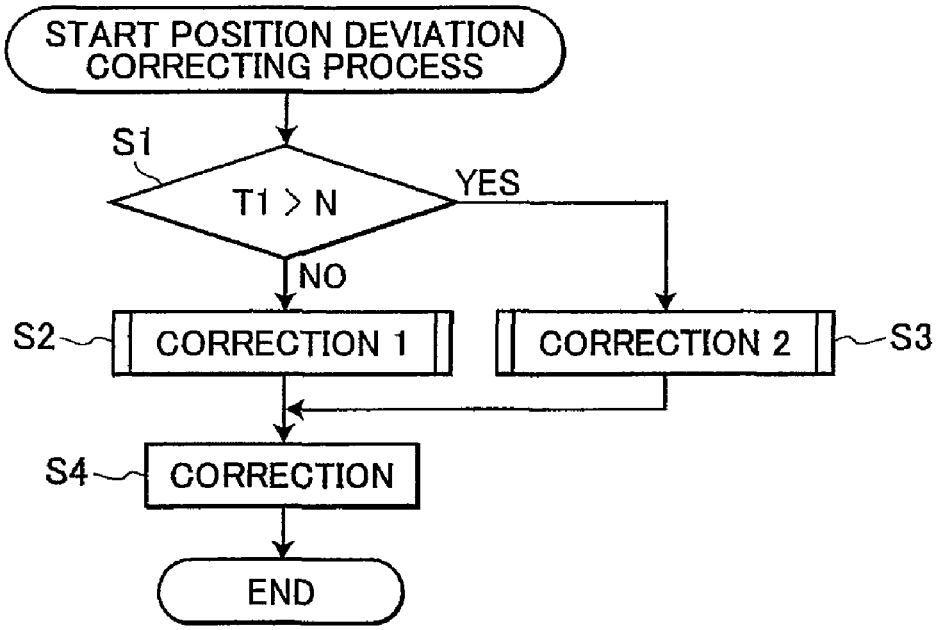
FIG. 9 is a flow diagram showing a succession of procedural steps performed to correct a position deviation.

When a predetermined execution condition is satisfied, the CPU 61 determines that the test instruction is issued, and carries out the position deviation correcting process shown in FIG. 9. For example, the CPU 61 determines that the test instruction is issued, when a predetermined time has elapsed since the previous position deviation correcting process had completed or the number of recording medium on which images has been formed has reached the threshold value.

First of all, the CPU 61 determines whether the surface speed of the belt 29 is currently in the stable state or the unstable state. However, it is difficult to measure the actual surface speed of the belt 29. For this reason, in the present embodiment, the CPU 61 determines whether or not the elapsed time T1 from the start of control of rotational driving of the belt 29 or the temperature of the fixing unit 23 to the target temperature is longer than a predetermined time period N in S1. For example, if the predetermined time has elapsed while the printer 1 is forming an image, it can be assumed that the surface speed is in the stable. On the other hand, if the predetermined time has elapsed while the printer 1 is in the sleep state, it can be assumed that the surface speed is in the unstable.

If the elapsed time T1 is shorter than the predetermined time period N (S1:NO), the CPU 61 determines that the surface speed is currently in the unstable state, and carries out correction 1 in S2. In the correction 1, a position deviation amount A1 is detected in the first operation and a position deviation amount A2 is detected in the second operation, as shown in FIG. 8, an average value H1 of the position deviation amount A1 and the position deviation amount A2 is calculated, and a predetermined reference value (a position deviation amount of a right position of a measurement-color mark from a right position of the reference-color mark) is subtracted from the calculated average value H1. Then in S4, the value obtained as the result of the subtraction is stored in the RAM 65 or the EEPROM 67 as a correction amount of an image formation position of the measurement color.

On the contrary, if the elapsed time T1 is longer than the predetermined time period N in S1 (S1: YES), the CPU 61 determines that the surface speed is currently in the stable state, and carries out correction 2 in S3. In the correction 2, a position deviation amount A3 is detected in the first operation and a position deviation amount A4 is detected in the second operation, as shown in FIG. 8, a value H3 is calculated by adding a first adjustment amount B1 to one of the position deviation amount A3 and the position deviation amount A4 or an average value H2 of the position deviation amounts A3 and A4, and the predetermined reference value is subtracted from the value H3.

The first adjustment amount B1 is set to be a value so that the value of H1 obtained in the unstable state is substantially same as the value H3 obtained in the stable state, for example, the substantial half value of the difference between the position deviation amount A1 detected in the unstable state and the position deviation amount A3 (or A4) detected in the stable state (i.e., the substantial half value of a distance difference between the position of the mark of the measurement color formed in the unstable state and the position of the corresponding mark formed in the stable state). Then in S4, the value obtained as the result of the subtraction is stored in the RAM 65 or the EEPROM 67 as the correction amount of the image formation position of the measurement color.

After the correction 1 or 2 has been carried out, upon receipt of the image forming instruction, the image forming unit 17 forms an image of each color at the image formation position which has been corrected using the correction amount stored in RAM 65, on a recording medium 7.

Note that if the image forming instruction is issued immediately after the power switch is turned on or the like, the temperature of the fixing unit 23 may not reach the target temperature at the time when the image forming unit 17 is forming an image on (transferring an image onto) a recording medium 7. However, the printer 1 of the present embodiment controls the temperature of the fixing unit 23 to become stable at the target temperature by the time the recording medium reaches the fixing unit 23.

Effect of the First Embodiment

In the first embodiment, the state of the surface speed when the test instruction is issued is taken into consideration. Therefore, even if the state of the surface speed when the test instruction is different from the state of the surface speed when the image forming instruction is issued, it is possible to prevent the image formation position from deviating excessively.

Further, in the first embodiment, the value of H1 obtained in the unstable state is substantially same as the value H3 obtained in the stable state in the stable state as shown in FIG. 8. In other words, the correction amount of the image formation position of the measurement color is substantially the same (i.e., approximately the average amount of the position deviation amount detected in a stable state and that detected in unstable state) irrespective of whether the first operation and the second operation are performed in the stable state or the unstable state. Accordingly, even if the surface speed of the belt 29 at the time when the test instruction is issued is different from the surface speed of the belt 29 at the time when the image forming instruction is issued, for example, the surface speed of the belt 29 at the time when the test instruction is issued is stable and the surface speed of the belt 29 at the time when the image forming instruction is issued is unstable, it is possible to prevent the image formation position from deviating excessively.

Further, in the first embodiment, whether or not the surface speed of the belt 29 is in the stable state is determined based on whether or not the elapsed time T1 is longer than the predetermined time period N. Accordingly, there is no need to install a temperature sensor to measure the temperature of the fixing unit 23, a sensor to measure the rotation speed of the belt 29 or a similar device.

Further, in the first embodiment, the fixing unit 23 is controlled to reach the target temperature not only when the image forming instruction is issued but also when the test instruction is issued. Since an environment in which the test instruction is issued is same as an environment in which the image forming instruction is issued, the printer 1 of the first embodiment can correct an image formation position with higher accuracy as compared with the configuration in which the fixing unit 23 keeps an off state even if the test instruction is issued.

The image formation position in the sub-scanning direction is more easily affected by the surface speed of the belt 29 than the image formation position in the main-scanning direction. In particular, at the beginning of formation of the above pattern, the surface speed of the belt 29 is frequently unstable. For this reason, the printer of the first embodiment forms the first pattern 91A, which is easily affected by variation in the surface speed, after the formation of the second pattern 91B.

Second Embodiment

Figure 10:
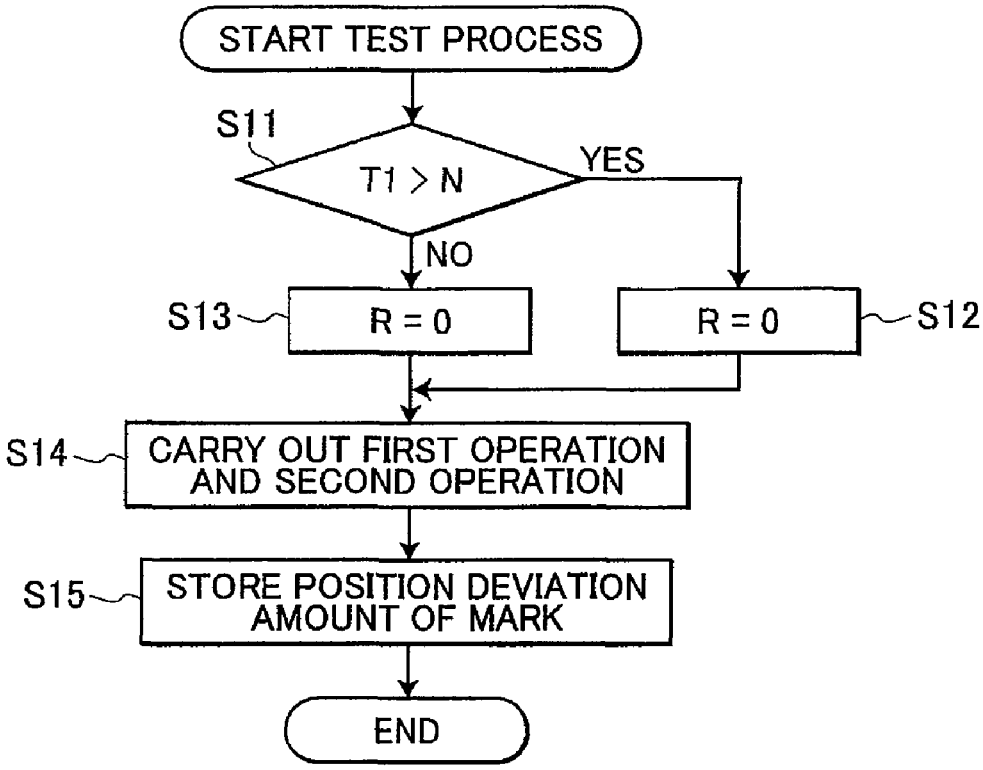
FIG. 10 is a flow diagram showing a succession of procedural steps of a test process according to a second embodiment of the present invention.
Figure 11:
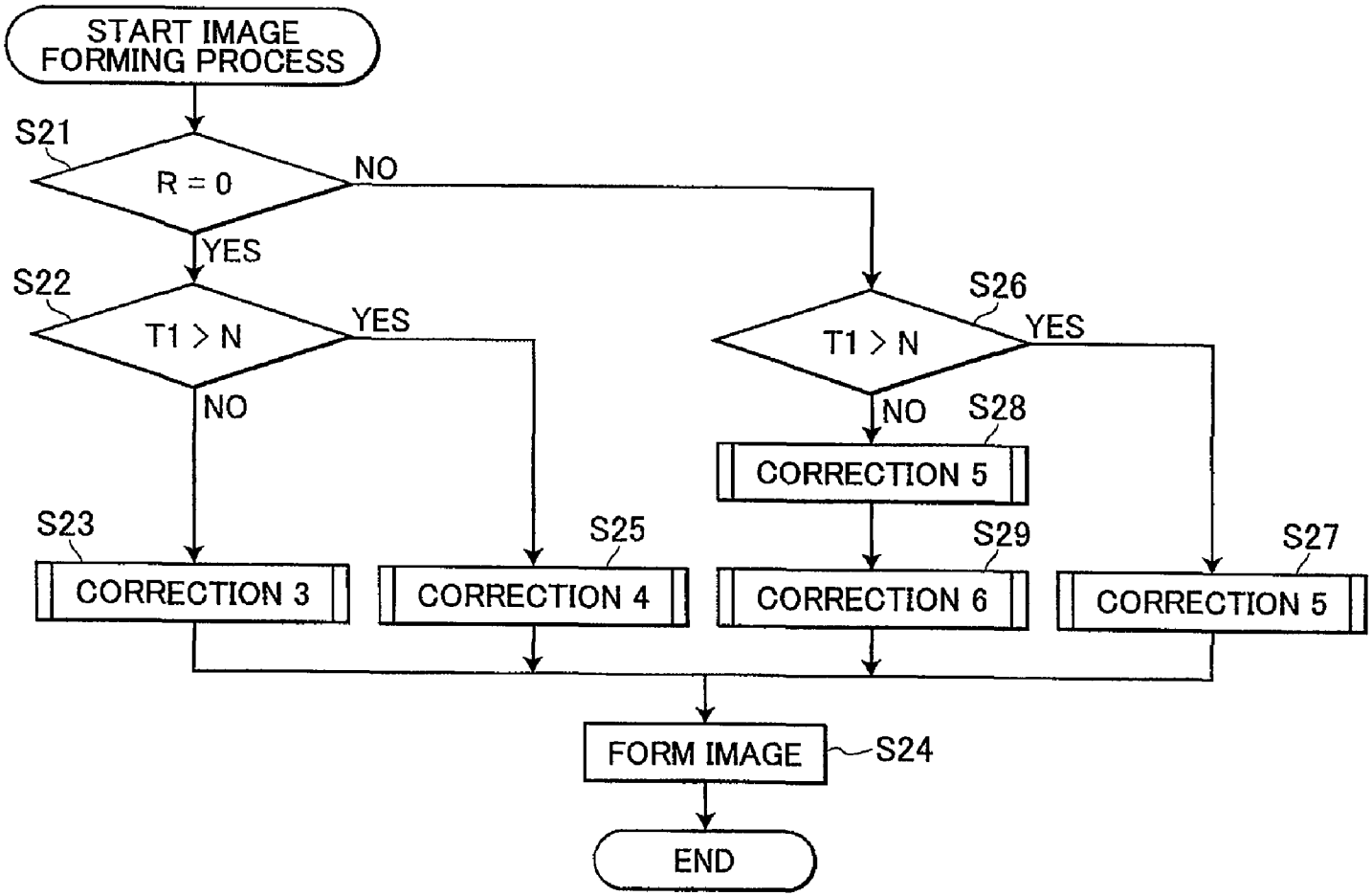
FIG. 11 is a flow diagram showing a succession of procedural steps of an image formation process.
Figure 12:
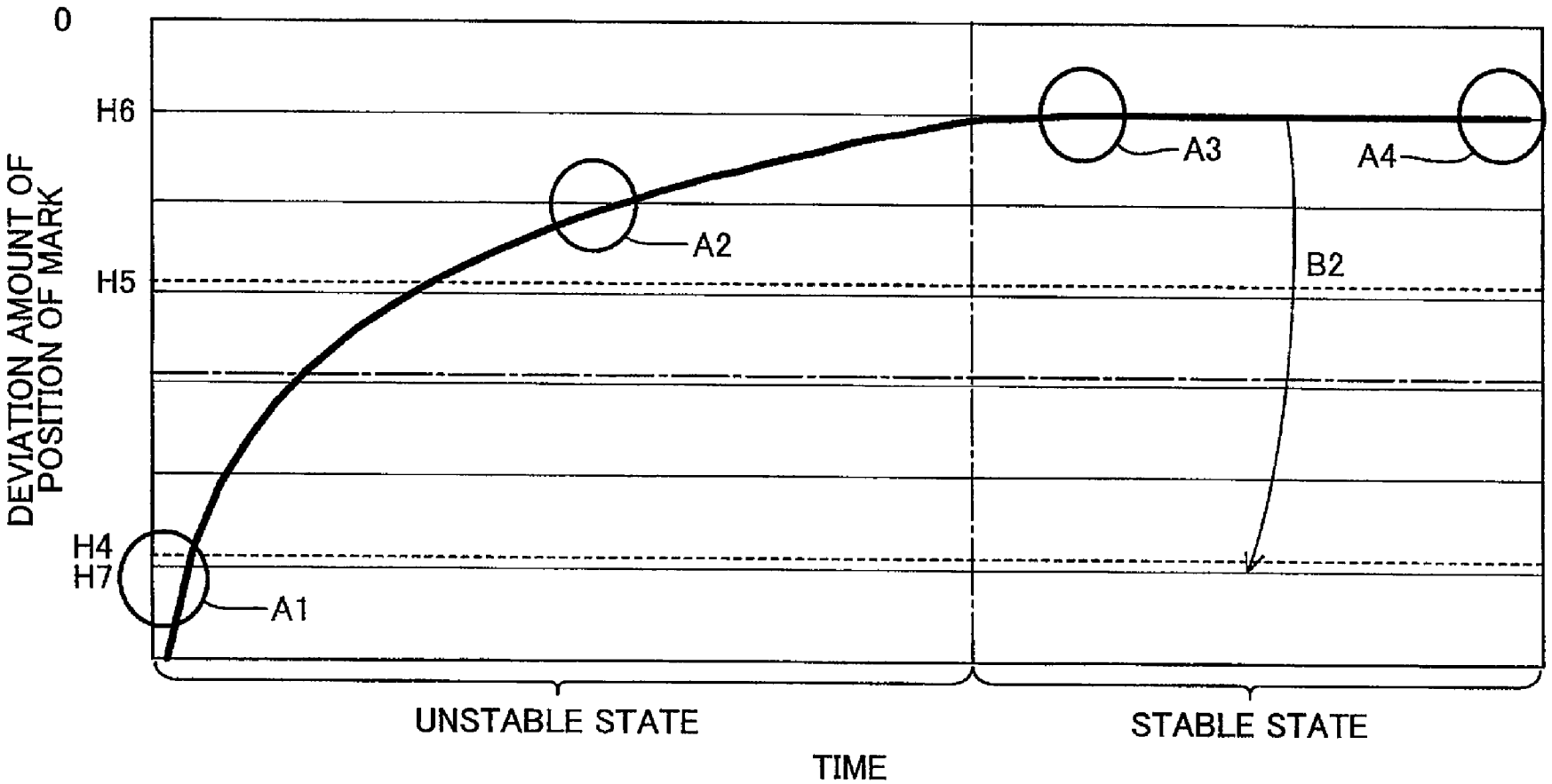
FIG. 12 is a graph showing the relationship of the variation in a mark position with execution timings of the first operation and the second operation.

FIGS. 10-12 show a second embodiment, which is different in the position deviation correction process from the first embodiment and which is the same in the remaining as the first embodiment. Accordingly, repetitious description is omitted here by giving elements and parts with the same reference numbers as those of the first embodiment, so only the difference will now be detailed below.

(Position Deviation Correction Process)

The position deviation correction process according to this embodiment consists of a test process performed at the time when the test instruction is issued and a correction process performed during an image forming process.

1. Test Process

When the execution condition described in the first embodiment is satisfied, the CPU 61 determines that the test instruction is issued, and executes the procedure of the test process shown in FIG. 10. In S11, the CPU 61 determines whether the surface speed is currently in the stable state or the unstable state, which determination is the same as that made in S1 in FIG. 9. If the elapsed time T1 from the start of control of the rotational driving of the belt 29 or the temperature of the fixing unit 23 to the target temperature is longer than the predetermined time period N (S11:YES), the CPU 61 determines that the surface speed is currently in the stable state, and sets a flag "R" to "1" (S12). On the other hand, the elapsed time T1 is shorter than the predetermined time period N (S11:NO), the CPU 61 determines that the surface speed is currently in the unstable state, and sets the flag "R" to "0" (S13).

Then in S14, the CPU 61 provides data of the first pattern 91A and the second pattern 91B stored in the EEPROM 67 to the image forming unit 17. The image forming unit 17 carries out the first operation and the second operation based on the data of the first pattern 91A and the second pattern 91B, and obtains binary signals sequentially sent from the optical sensor 81 during the first operation and the second operation.

In S15, based on the obtained binary signals, the CPU 61 stores the position deviation amounts of the marks 93C (95C), 93M (95M), and 93 Y (95Y), one for each of the measurement colors, with respect to mark 93K (95K) of the reference color into RAM 65 or EEPROM 67 and terminates the test process.

Normally, the position deviation amounts stored in the RAM 65 or the like can vary depending on the surface speed of the belt 29. However, for simplification of the description in the present embodiment, the position deviation amounts A1 and A2 in FIG. 12 are assumed to be stored in RAM 65 or the like if the CPU 61 determines that the surface speed is currently in the stable state in S11, and the position deviation amounts A3 and A4 in FIG. 12 are assumed to be stored if the CPU 61 determines that the surface speed is currently in the unstable state in S11.

2. Image Forming Process (Correction Process)

Responsive to the image forming instruction from the user, for example, the CPU 61 carries out the image forming process shown in FIG. 11. First of all, the flag "R" is read in S21 to determine whether the deviation amounts of the marks 93 (95) stored in EEPROM 67 or the like have been detected in the stable state or the unstable state.

(1) Correction 3

If the CPU 61 determines that the deviation amounts of the marks 93 (95) have been detected in the unstable state (R="0") (S21: YES), in S22 the CPU 61 determines whether a current surface speed is in the stable state or the unstable state in the same manner as performed in S11 in FIG. 10.

If the CPU 61 determines that the current surface speed is in the unstable state (S22: YES), the CPU 61 carries out a correction 3 in S23. That is, the correction 3 is carried out when the test process (detection of the position deviation amounts of the marks 93 (95) in FIG. 10) was performed in the unstable state and the image formation will be also performed in the unstable state. For this reason, in the correction 3, the correction amount of the image formation position of each measurement color is calculated while weighing the position deviation amount A1 of each of the marks 93 (95) formed and detected in the unstable state.

Specifically, the below calculation expression is used in the correction 3.

$$H4=X1\cdot A1+X2\cdot A2,\ \text{where}\ X1+X2=1\ \text{and}\ X1>X2$$

This expression weights the position deviation amount A1 detected in the unstablest state among the position deviation amounts A1 and A2 detected in the unstable state. In other words, the expression weights the position deviation amount A1 by multiplying a multiplier X1 larger than a multiplier X2 multiplied to the other position deviation amount A2, and then calculates an average value H4 (see FIG. 12) of the position deviation amount. For example, the multipliers can be set to be "X1=0.6, X2=0.4", "X1=0.7, X2=0.3", or "X1=1.0, X2=0".

Then, the correction amount of the image formation position of the corresponding measurement color is calculated by subtracting the predetermined reference value described in the first embodiment from the average value H4. In S24, the CPU 61 expands image data received along with the image forming instruction, using the image formation position corrected based on the correction amount obtained in the correction 3, and provides the expanded image data to the image forming unit 17. Thus, an image in each measurement color is formed at the image formation position that has been corrected on a recording medium 7, and the image forming process is terminated.

(2) Correction 4

If the CPU 61 determines that the current surface speed is in the stable state (S22: YES), the CPU 61 carries out the correction 4 in S25. That is, the correction 4 is carried out when the test process was performed in the unstable state and the image formation will be performed in the stable state. For this reason, in the correction 4, the correction amount of the image formation position of each measurement color is calculated while weighing the position deviation amount A2 of each of the marks 93 (95) formed and detected in the unstable state, since the position deviation amount A2 is closer to the stable state than the position deviation amount A1.

Specifically, the below calculation expression is used in the correction 4.

$$H5=Y1\cdot A1+Y2\cdot A2, \text{ where, } Y1+Y2=1 \text{ and } Y1<Y2$$

This expression weights the position deviation amount A2 closer to the stable state than the position deviation amount A1. In other words, the expression weights the position deviation amount A2 by multiplying a multiplier Y2 larger than a multiplier Y1 multiplied to the other position deviation amount A1 and then calculates an average value H5 (see FIG. 12) of the position deviation amounts. For example, the multipliers can be set to be "Y1=0.4, Y2=0.6", "Y1=0.3, Y2=0.7", or "Y1=0.2, Y2=0.8".

Then, the correction amount of the image formation position of the corresponding measurement color is calculated by subtracting the predetermined reference value described in the first embodiment from the average value H5. Then the procedure proceeds to S24.

(3) Correction 5

If the CPU 62 determines that the deviation amounts of the marks 93 (95) have been detected in the stable state (R="1") (S21: NO), in S26 the CPU 61 determines whether the current surface speed is in the stable state or the unstable state in the same manner as performed in S11 in FIG. 10.

If the CPU 61 determines that the current surface speed is in the stable state (S26: YES), the CPU 61 carries out a correction 5 in S27. That is, the correction 5 is carried out when the test process was performed in the stable state and the image formation will be also performed in the stable state. For this reason, in the correction 5, the correction amount of the image formation position of each measurement color is calculated based on the position deviation amounts A3 and A4 of each of the marks 93 (95) formed and detected in the unstable state.

Specifically, the below calculation expression is used in the correction 5.

$$H6=Z1\cdot A3+Z2\cdot A4, \text{ where } Z1+Z2=1$$

This expression calculates the average value H6 (see FIG. 12) of the position deviation amounts A3 and A4 detected in the stable state. The combination of the multipliers of the position deviation amount A3 and A4 is exemplified by a combination in which both position deviation amount A3 and A4 are equally weighed (i.e., "Z1=0.5, Z2=0.5"), a combination in which the position deviation amount A4 is weighed (i.e., "Z1=0.4, Z2=0.6" or "Z1=0.3, Z2=0.7"), and a combination in which either position deviation amount A3 or A4 is used (i.e., "Z1=1.0, Z2=0" or "Z1=0, Z2=1.0").

Then, the correction amount of the image formation position of the corresponding measurement color is calculated by subtracting the predetermined reference value described in the first embodiment from the average value H6. Then the procedure proceeds to S24.

(4) Correction 6

If the CPU 61 determines that the current surface speed is in the unstable state (S26: NO), the CPU 61 carries out the above described correction 5 in S28 and a correction 6 in S29. That is, the correction 6 is carried out when the test process was performed in the stable state and the image formation will be performed in the unstable state.

In the correction 6, a value H7 is calculated by adding a second adjustment amount B1 to the above average value H6, and the predetermined reference value is subtracted from the value H6. The second adjustment amount B1 is set to be, for example, the difference value between the position deviation amount A1 detected in the unstable state and the position deviation amount A3 (or A4) detected in the stable state (i.e., the distance difference between the mark 93 (95) of the measurement colors formed in the unstable state and the corresponding mark 93 (95) formed in the stable state) and exemplified by the twice the above first adjustment amount. Then, the procedure proceeds to S24.

The present second embodiment corrects the image formation positions, considering whether or not the image formation has been carried out in the stable state in addition to whether or not the test process has been carried out in the stable state. Accordingly, the second embodiment can further inhibit the influence caused by the difference between the surface speed of the belt 29 at the time when the test instruction is issued and the surface speed of the belt 29 at the time when the image forming instruction is issued, so that the image formation positions can be corrected with higher accuracy than the first embodiment.

Other Embodiments

Although the present invention has been described with respect to specific embodiments, it will be appreciated by one skilled in the art that a variety of changes may be made without departing from the scope of the invention.

(1) In the foregoing embodiments, the image-forming device is a direct-transferring color laser printer. Alternatively, the present invention may be applied to an intermediate-transferring color laser printer, or a printer using two, three, or more than four coloring agents. Further alternatively, application of the present invention even to a mono-color printer can accurately form an image on a proper position of a recording medium.

(2) The "image bearing member" of the foregoing embodiments takes the form of the belt 29 for transferring a recording medium. If an intermediate-transferring printer is used as the image-forming device, the image bearing member may be an intermediate-transferring belt.

(3) Differently from the foregoing embodiments, whether the surface speed of the belt 29 is in the stable state or in the unstable state may be determined by means of a temperature sensor which measures the temperature of the fixing unit 23, a sensor (e.g., an encoder) which measures the rotational speed of the belt 29, or another device. Further, the judgment method performed as a test process may be different from that performed as image formation. For example, a temperature sensor may be used for the determination that is to be made as a test process and a time elapsed from turning on the fixing unit 23 may be used for the determination to be made as image formation.

(4) A position deviation amount of each measurement color is detected in the first operation and in the second operation during the position deviation correcting process, i.e., twice in total. Alternatively, each position deviation amount may be detected three times or more.

What is claimed is:

1. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a detecting unit configured to detect the actual position;

a processor;

memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received;

perform a second determination of whether the surface speed when the image-forming unit receives the image-forming instruction is stable or unstable; and calculate a correction amount based on the deviation, the first determination, and the second determination; and a storing unit configured to store a first correction information including the actual position and the first determination;

wherein the image-forming unit forms, in response to the image-forming instruction, an image on a position of the surface, the position being corrected based on the correction amount.

2. The image-forming device according to claim 1, wherein the pattern data is provided a plurality of times in response to the test instruction, wherein the image-forming unit forms the actual test pattern at times the pattern data is provided, wherein the detecting unit detects the actual position at times the image-forming unit forms the actual test pattern, wherein the deviation is calculated at times the detecting unit detects the actual position, and wherein the correction amount is calculated based on an average of the deviations if the first determination indicates that the surface speed is unstable when the test pattern is received, and the correction amount is calculated based on a value that is a first adjustment amount plus one of the deviations if the first determination indicates that the surface speed is stable when the test pattern is received.

3. The image-forming device according to claim 1, wherein the pattern data is provided a plurality of times in response to the test instruction, wherein the image-forming unit forms the actual test pattern at times the pattern data is provided, wherein the detecting unit detects the actual position at times the image-forming unit forms the actual test pattern, wherein the deviation is calculated at times the detecting unit detects the actual position, and wherein the correction amount is calculated based on an average of the deviations if the first determination indicates that the surface speed is unstable when the test pattern is received, and the correction amount is calculated based on a value that is a first adjustment amount plus an average of the deviations if the first determination indicates that the surface speed is stable when the test pattern is received.

4. The image-forming device according to claim 2, wherein the first adjustment amount is a half of a distance difference between the actual position of the actual test pattern formed when the surface speed is unstable and the actual position of the actual test pattern formed when the surface speed is stable.

5. The image-forming device according to claim 3, wherein the first adjustment amount is a half of a distance difference between the actual position of the actual test pattern formed when the surface speed is unstable and the actual position of the actual test pattern formed when the surface speed is stable.

6. The image-forming device according to claim 1, wherein the pattern data is provided a plurality of times in response to the test instruction, wherein the image-forming unit forms the actual test pattern at times the pattern data is provided, wherein the detecting unit detects the actual position at times the image-forming unit forms the actual test pattern, wherein the deviation is calculated at times the detecting unit detects the actual position, and wherein the correction amount is calculated by multiplying multipliers to each of the deviations, the multiplier multiplied to each deviation being changed based on a combination of the first determination and the second determination.

7. The image-forming device according to claim 6, wherein if the first determination indicates that the surface speed is stable when the test pattern is received and the second determination indicates that the surface speed is unstable when the image-forming unit receives the image-forming instruction, the correction amount is calculated based on a value that is a second adjustment amount plus an average of the deviations.

8. The image-forming device according to claim 7, wherein the second adjustment amount is a distance difference between the actual position of the test pattern formed when the surface speed is unstable and the actual position of the test pattern formed when the surface speed is stable.

9. The image-forming device according to claim 1, further comprising a fixing unit configured to thermally fix an image formed on the surface to a recording medium, wherein the first determination is performed based on an operation state of the fixing unit.

10. The image-forming device according to claim 9, further comprising a fixing controller configured to control, in response to both the test instruction and the image forming instruction, the fixing unit so that a temperature of the fixing unit reaches a target temperature.

11. The image-forming device according to claim 1, wherein the actual pattern includes a first test pattern and a second test pattern, wherein the deviation is calculated by detecting a first deviation of the actual position in a predetermined direction based on the first test pattern and detecting a second deviation of the actual position in a direction perpendicular to the predetermined direction based on the second test pattern, and wherein the image-forming unit forms the first pattern prior to the second pattern.

12. The image forming device according to claim 1, wherein the image-forming unit is configured to form the actual test pattern on the actual position of the surface in accordance with the pattern data regardless of the surface speed, and wherein the detecting unit is configured to detect the actual position regardless of the surface speed.

13. The image forming device according to claim 12, wherein the image-forming unit forms the image on the position of the surface, the position being corrected based on the correction amount, after the surface speed has become stable.

14. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a detecting unit configured to detect the actual position;

a processor; and memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received; and calculate a correction amount based on the deviation and the first determination, wherein the image-forming unit forms, in response to the image-forming instruction, an image on a position of the surface, the position being corrected based on the correction amount, wherein the pattern data is provided a plurality of times in response to the test instruction, wherein the image-forming unit forms the actual test pattern every time the pattern data is provided, wherein the detecting unit detects the actual position every time the image-forming unit forms the actual test pattern, wherein the deviation is calculated every time the detecting unit detects the actual position, and wherein the correction amount is calculated based on an average of the deviations if the first determination indicates that the surface speed is unstable when the test pattern is received, and the correction amount is calculated based on a value that is a first adjustment amount plus one of the deviations if the first determination indicates that the surface speed is stable when the test pattern is received.

15. The image-forming device according to claim 14, wherein the first adjustment amount is a half of a distance difference between the actual position of the actual test pattern formed when the surface speed is unstable and the actual position of the actual test pattern formed when the surface speed is stable.

16. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a detecting unit configured to detect the actual position;

a processor; and memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received; and calculate a correction amount based on the deviation and the first determination, wherein the image-forming unit forms, in response to the image-forming instruction, an image on a position of the surface, the position being corrected based on the correction amount, wherein the pattern data is provided a plurality of times in response to the test instruction, wherein the image-forming unit forms the actual test pattern every time the pattern data is provided, wherein the detecting unit detects the actual position every time the image-forming unit forms the actual test pattern, wherein the deviation is calculated every time the detecting unit detects the actual position, and wherein the correction amount is calculated based on an average of the deviations if the first determination indicates that the surface speed is unstable when the test pattern is received, and the correction amount is calculated based on a value that is a first adjustment amount plus an average of the deviations if the first determination indicates that the surface speed is stable when the test pattern is received.

17. The image-forming device according to claim 16, wherein the first adjustment amount is a half of a distance difference between the actual position of the actual test pattern formed when the surface speed is unstable and the actual position of the actual test pattern formed when the surface speed is stable.

18. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a storing unit configured to store a first correction information including the actual position and first determination result information;

a detecting unit configured to detect the actual position;

a processor; and memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received to obtain the first determination result information;

calculate a correction amount based on the deviation and the first determination; and perform a second determination of whether the surface speed is stable or unstable when the image-forming unit receives the image-forming instruction, wherein the image-forming unit forms, in response to the image-forming instruction, an image on a position of the surface, the position being corrected based on the correction amount, wherein the image-forming unit forms, in response to the image-forming instruction, an image on a position of the surface corrected based on the first correction information and the second determination, wherein the pattern data is provided a plurality of times in response to the test instruction, wherein the image-forming unit forms the actual test pattern every time the pattern data is provided, wherein the detecting unit detects the actual position every time the image-forming unit forms the actual test pattern, wherein the deviation is calculated every time the detecting unit detects the actual position, wherein the correction amount is calculated by multiplying multipliers to each of the deviations, the multiplier multiplied to each deviation being changed based on a combination of the first determination and the second determination, and wherein if the first determination indicates that the surface speed is stable when the test pattern is received and the second determination indicates that the surface speed is unstable when the image-forming unit receives the image-forming instruction, the correction amount is calculated based on a value that is a second adjustment amount plus an average of the deviations.

19. The image-forming device according to claim 18, wherein the second adjustment amount is a distance difference between the actual position of the test pattern formed when the surface speed is unstable and the actual position of the test pattern formed when the surface speed is stable.

20. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a detecting unit configured to detect the actual position;

a processor;

memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received;

perform a second determination of whether the surface speed when the image-forming unit receives the image-forming instruction is stable or unstable; and calculate a correction amount based on the deviation, the first determination, and the second determination; and a storing unit configured to store a first correction information including the actual position and the first determination;

wherein the image-forming unit forms, in response to the image-forming instruction, an image on a position of the surface, the position being corrected based on the correction amount, wherein the pattern data is provided a plurality of times in response to the test instruction, wherein the image-forming unit forms the actual test pattern at times the pattern data is provided, wherein the detecting unit detects the actual position at times the image-forming unit forms the actual test pattern, wherein the deviation is calculated at times the detecting unit detects the actual position, and wherein the correction amount is calculated by multiplying multipliers to each of the deviations, the multiplier multiplied to each deviation being changed based on a combination of the first determination and the second determination.

21. An image-forming device comprising:

an image bearing member having a surface moving at a surface speed;

an image-forming unit configured to form an actual test pattern on an actual position of the surface in accordance with pattern data, and configured to form an image in response to an image-forming instruction;

a detecting unit configured to detect the actual position;

a processor;

memory storing computer readable instructions that, when executed by the processor, cause the image-forming device to:

provide the pattern data indicative of a target test pattern to be formed on a target position of the surface in response to a test instruction;

calculate a deviation of the actual position from the target position;

perform a first determination of whether the surface speed is stable or unstable when the test instruction is received;

perform a second determination of whether the surface speed when the image-forming unit receives the image-forming instruction is stable or unstable; and calculate a correction amount based on the deviation, the first determination, and the second determination;

a storing unit configured to store a first correction information including the actual position and the first determination; and a fixing unit configured to thermally fix an image formed on the surface to a recording medium, wherein the image-forming unit forms, in response to the image-forming instruction, an image on a position of the surface, the position being corrected based on the correction amount, and wherein the first determination is performed based on an operation state of the fixing unit.

* * * * *